US007044141B2

(12) United States Patent
Yasuda

(10) Patent No.: US 7,044,141 B2
(45) Date of Patent: May 16, 2006

(54) HAIR CLIP

(75) Inventor: Masahiro Yasuda, Osaka (JP)

(73) Assignee: Kabushiki Kaisha Yasuda Corporation, Osaka (JP)

( * ) Notice: Subject to any disclaimer, the term of this patent is extended or adjusted under 35 U.S.C. 154(b) by 61 days.

(21) Appl. No.: 10/796,729

(22) Filed: Mar. 9, 2004

(65) Prior Publication Data

US 2005/0199258 A1 Sep. 15, 2005

(51) Int. Cl.
*A45D 8/20* (2006.01)

(52) U.S. Cl. ..... 132/277

(58) Field of Classification Search ..... 132/277, 132/276, 278, 279; 24/499, 500; D28/39, D28/40, 41, 42, 43
See application file for complete search history.

(56) References Cited

U.S. PATENT DOCUMENTS 2,883,993 A * 4/1959 Laughton ..... 132/277
2,979,060 A * 4/1961 Reiner ..... 132/277
6,019,108 A 2/2000 Chen
6,192,894 B1 * 2/2001 Yasuda ..... 132/277
D464,465 S * 10/2002 Yasuda ..... D28/40

FOREIGN PATENT DOCUMENTS

BR 992417 5/1965
FR 131757 8/1963

* cited by examiner

*Primary Examiner*—Todd E. Manahan

(57) ABSTRACT

A hair clip includes a pair of hair retainers for retains hair therebetween. The first hair retainer is provided with a hinge ledge cover connecting inner side edge portions of the outside hinge ledges of the first hair retainer located at the second end portion side thereof and covering inner side edge portions of the inside hinge ledges of the second hair retainer, the inner side edge portions being portions located at the second end portion side of the second hair retainer. Each of the inside hinge ledges is provided with a hinge ledge cover introducing slot corresponding to the hinge ledge cover at each basal end portion thereof, so that the pair of hair retainers takes a closed position with the hinge ledge cover fitted in the hinge ledge cover introducing slots, whereby the hinge ledge cover covers the inner side edge portions of the inside hinge ledges and a space between the inside hinge ledges irrespective of an opening angle of the hair retainers.

19 Claims, 4 Drawing Sheets

HAIR CLIP

BACKGROUND OF THE INVENTION

1. Field of the Invention

This invention relates to a hair clip for retaining hair between a pair of hair retainers pivoted by hinge portions, and more particularly, to a hair clip for temporarily retaining hair at the time of setting hair, applying makeup or the like.

2. Description of Related Art

FIGS. 5 and 6 illustrate a conventional hair clip B. The hair clip B includes a pair of hair retainers 51 and 52 pivoted at the first end portion thereof 51*b* and 52*b* and urged by a coil spring 56 so as to close the second end portions 51*a* and 52*a* of the hair retainers 51 and 52.

Each hair retainer 51 and 52 is provided with a pair of opposing hinge ledges 53, 53, 54 and 54 at the first end portion 51*b* and 52*b*. The pair of hinge ledges 53 and 53 of one of the hair retainers 51 are disposed outside the pair of hinge ledges 54 and 54 of the other of hair retainers 52. These hinge ledges 53, 53, 54 and 54 are pivoted by a pivotal shaft 55 (i.e., a rivet) on which the coil spring 56 is wounded. Thus, the pair of hair retainers 51 and 52 are allowed to rotate, i.e., open and close, about the pivotal shaft 55 with the other end 51*a* and 52*a* of the hair retainers 51 and 52 urged in a closing direction.

Therefore, in a state in which the hair clip B is not in use, the hair retainers 51 and 52 are closed due to the spring force of the coil spring 56. By gripping the lever portions 51*b* and 52*b*, the hair retainers 51 and 52 are opened so that hair can be retained between the hair retainers 51 and 52.

In the meantime, the corresponding hinge ledges 53 and 54 of the hair retainers 51 and 52 are disposed so as to contact with each other. However, a gap of about 0.01 mm is usually formed between the adjacent hinge ledges 53 and 54 so that the hair retainers 51 and 52 can be freely opened and closed. As a result, there is the fear of unintentionally introducing hair into the gap, i.e., between the adjacent hinge ledges 53 and 54. Also, another gap of about 0.01 mm is formed between the head portion 55*a* and 55*b* of the pivotal shaft 55 and the hinge ledge 53 and 53 located outside. Accordingly, hair may also be introduced unintentionally into the gap, i.e., between the head portion 55*a* and 55*b* and the hinge ledges 53 and 53. In cases where the user's hair is introduced into these gaps and caught therein, a few hairs may be pulled out of the user's head. This not only gives the pain to the user but also makes the user uncomfortable because of losing hair.

In view of the above, the present inventor proposed a hair clip provided with hinge ledge covers each formed on the side edge of each hinge ledge and covering the corresponding inside hinge ledge (see Japanese Unexamined Laid-open Patent Publication No. P2000-333721A).

However, even in the hair clip, there is a fear that hair is introduced into the gap between the adjacent hinge ledges and/or the space between the inner side hinge ledges and caught therein.

SUMMARY OF THE INVENTION

It is an object of the present invention to provide a hair clip capable of assuredly preventing a hair-caught at the hinge side of the hair clip.

A hair clip comprises first and second hair retainers for retaining hair therebetween, each of the hair retainers having a first end portion and a second end portion, a pivotal shaft for pivoting the hair retainers at the first end portions and a spring for urging the second end portions of the hair retainers in a closing direction thereof. The first hair retainer is provided with a pair of opposing outside hinge ledges at the first end portion and the second hair retainer is provided with a pair of opposing inside hinge ledges at the first end portion. The pair of outside hinge ledges of the first hair retainer are disposed outside of the pair of inside hinge ledges of the second retainer. The pivotal shaft is inserted into shaft-receiving apertures formed in the inside and outside hinge ledges so that the pair of hair retainers are pivoted about the pivotal shaft. The hair clip is characterized in that: the first hair retainer is provided with a hinge ledge cover connecting inner edge portions of the outside hinge ledges of the first hair retainer located at the second end portion side thereof and covering inner side edge portions of the inside hinge ledges of the second hair retainer, the inner side edge portions being portions located at the second end portion side of the second hair retainer, each of the inside hinge ledges is provided with a hinge ledge cover introducing slot corresponding to the hinge ledge cover at each basal end portion thereof, so that the pair of hair retainers takes a closed position with the hinge ledge cover fitted in the hinge ledge cover introducing slots, whereby the hinge ledge cover covers the inner side edge portions of the inside hinge ledges and an space between the inside hinge ledges irrespective of an opening angle of the hair retainers.

With this hair clip according to the present invention, since the first hair retainer is provided with a hinge ledge cover connecting inner side edge portions of the outside hinge ledges of the first hair retainer located at the second end portion side thereof and covering inner side edge portions of the inside hinge ledges of the second hair retainer, the gap between the adjacent inside and outside hinge ledges and the space between the inside hinge ledges are covered by the hinge ledge cover. Accordingly, hair is prevented from being introduced into the gap or the space, and therefore it is prevented that hair is caught by the hair clip and pulled out of a user's head when detaching the hair clip from the user's head. Thus, the hair clip does not make the user uncomfortable. Furthermore, since the hinge ledge cover is provided along the inner side edge portions of the outside hinge ledges, the outside hinge ledges are strengthened, resulting in enhanced durability.

It is preferable that the hinge ledge cover introducing slot extends to a region below the pivotal shaft, whereby a tip end of the hinge ledge cover is positioned below the pivotal shaft in the hinge ledge cover introducing slot when the pair of hear retainers are in a closed position. In this case, the hair retainers can be closed assuredly, and the hinge ledge cover can assuredly cover the inside hinge ledges even in a state in which the hair retainers are in an opened state.

It is preferable that the hinge ledge cover and the outside hinge ledges of the first hair retainer cover the inside hinge ledges of the second hair retainer irrespective of the opening angle of the hair retainers. In this case, since the inside hinge ledges are almost covered by the hinge ledge cover from the closed state to the opened state of the hair retainers, it is prevented that hair is caught by the hair clip at the time of opening and/or closing hair retainers.

It is preferable that the hinge ledge cover integrally extends from an inner surface of the first hair retainer. In this case, it is more assuredly prevented that hair is caught by the hair clip.

It is preferable that each of the outside hinge ledges of the first hair retainer is provided with an outwardly protruded cylindrical portion formed on an outer surface thereof and surrounding the shaft-receiving aperture thereof and that each of enlarged head portions of the pivotal shaft is disposed in the cylindrical portion. In this case, each of the enlarged head portions of the pivotal shaft is disposed in the cylindrical portion and therefore the gap between the enlarged head portion and the outside hinge ledge can be covered by the cylindrical portion. Accordingly, it is prevented that hair is caught by the gap and pulled out of a user's head when detaching the hair clip from the user's head. Thus, the hair clip does not make the user uncomfortable. Furthermore, since the cylindrical portion is formed on the outside hinge portion, the outside hinge portion can be strengthened, resulting in enhanced durability.

The cylindrical portion may have an inclined or sloped outer surface, and is not limited to a specific configuration so long as it is possible to cover the enlarged head portion of the pivotal shaft.

It is preferable that the first hair retainer is an integral synthetic resin molded article. In this case, the first hair retainer can be easily colored or shaped as compared with a metallic hair retainer. Furthermore, in cases where the second hair retainer is made of metal, the first hair retainer can hide the metallic inside hinge ledges of the second hair retainer, thereby improving the appearance of the hair retainer. However, the first hair retainer can be made of metal such as aluminum, stainless or the like.

It is preferable that the spring is a coil spring wounded around the pivotal shaft. In this case, the hair retainers can be assuredly urged in its closing position with simple structure.

It is preferable that the second hair retainer is a metal plate press molded article. In this case, the second hair retainer can be formed easily. However, this second hair retainer can also be made of synthetic resin.

The hair clip according to the present invention can be preferably applied to a hair clip having elongated first and second hair retainers and lever portions at the first and second end portions.

BRIEF EXPLANATION OF THE DRAWINGS

Other objects and advantages of the present invention will become apparent from the detailed description of the preferred embodiments with reference to the attached drawings, wherein.

DETAILED DESCRIPTION OF THE PREFERRED EMBODIMENTS

Figure 1:
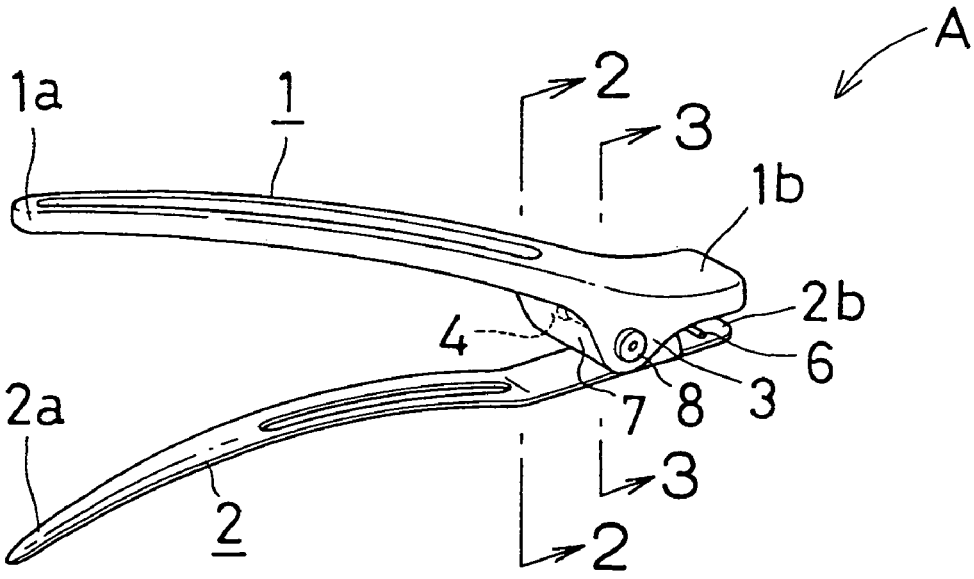
FIG. 1 shows a perspective view of a hair clip of an embodiment according to the present invention.

Preferred embodiments of the hair clip according to the present invention will now be described in detailed with reference to the accompanying drawings.

As shown in FIGS. 1–4, the hair clip includes a pair of elongated first and second hair retainers 1 and 2, a pivotal shaft 5 and a coil spring 6.

Each hair retainer 1 and 2 is an elongated narrow plate-like member having a lever portion 1*b* and 2*b* at its longitudinal one end portion (hereinafter referred to as "first end portion"). The first and second hair retainers 1 and 2 are pivoted at the first end portion 1*b* and 2*b* and urged by the coil spring 6 so that the other end portions (hereinafter referred to as "second end portions") 1*a* and 2*a* of the hair retainers 1 and 2 are closed.

The first hair retainer 1, which will be disposed outside when the hair clip A is attached to the user's head, is a semi-rigid plastic molded article. However, the material of the first hair retainer 1 is not limited to the above, and may be made of various materials.

The first hair retainer 1 is provided with a pair of opposing outside hinge ledges 3 and 3 downwardly extending from both lateral side edges of the first end portion 1*b* of the hair retainer 1. Each of the pair of outside hinge ledges 3 and 3 has a shaft-receiving aperture 3*a* and 3*a*.

On the other hand, the other hair retainer 2, which will be disposed inside when the hair clip is attached to the user's head (hereinafter referred to as "second hair retainer"), is an elongated plate-like metal press molded member. The plate-like member is preferably made of aluminum alloy which has enhanced corrosion resistance and is light in weight. However, the material of the hair retainer 2 is not limited to the above, and may be made of various materials including synthetic resin. The second hair retainer 2 is provided with a pair of opposing inside hinge ledges 4 and 4 upwardly extending from both lateral side edges of the first end portion 2*b* of the second hair retainer 2. Each of the inside hinge ledges 4 and 4 has a shaft-receiving aperture 4*a* and 4*a*.

Figure 2A:
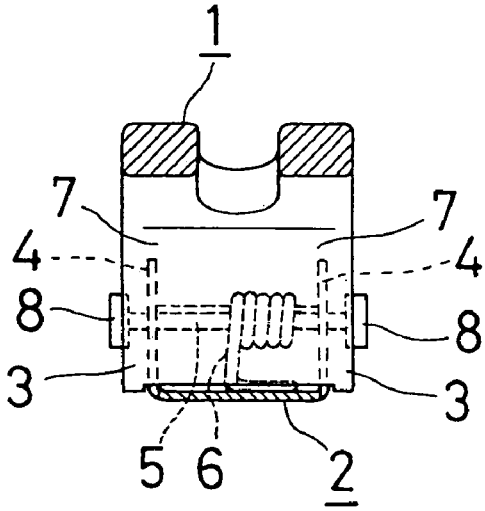
FIG. 2A shows an enlarged cross-sectional view taken along the line 2—2 in FIG. 1.
Figure 2B:
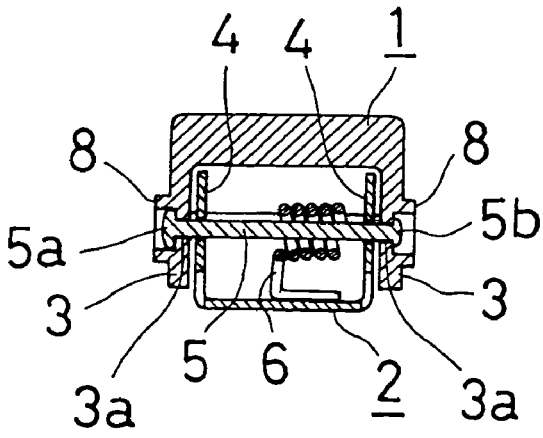
FIG. 2B shows an enlarged cross-sectional view taken along the line 3—3 in FIG. 1.
Figure 3:
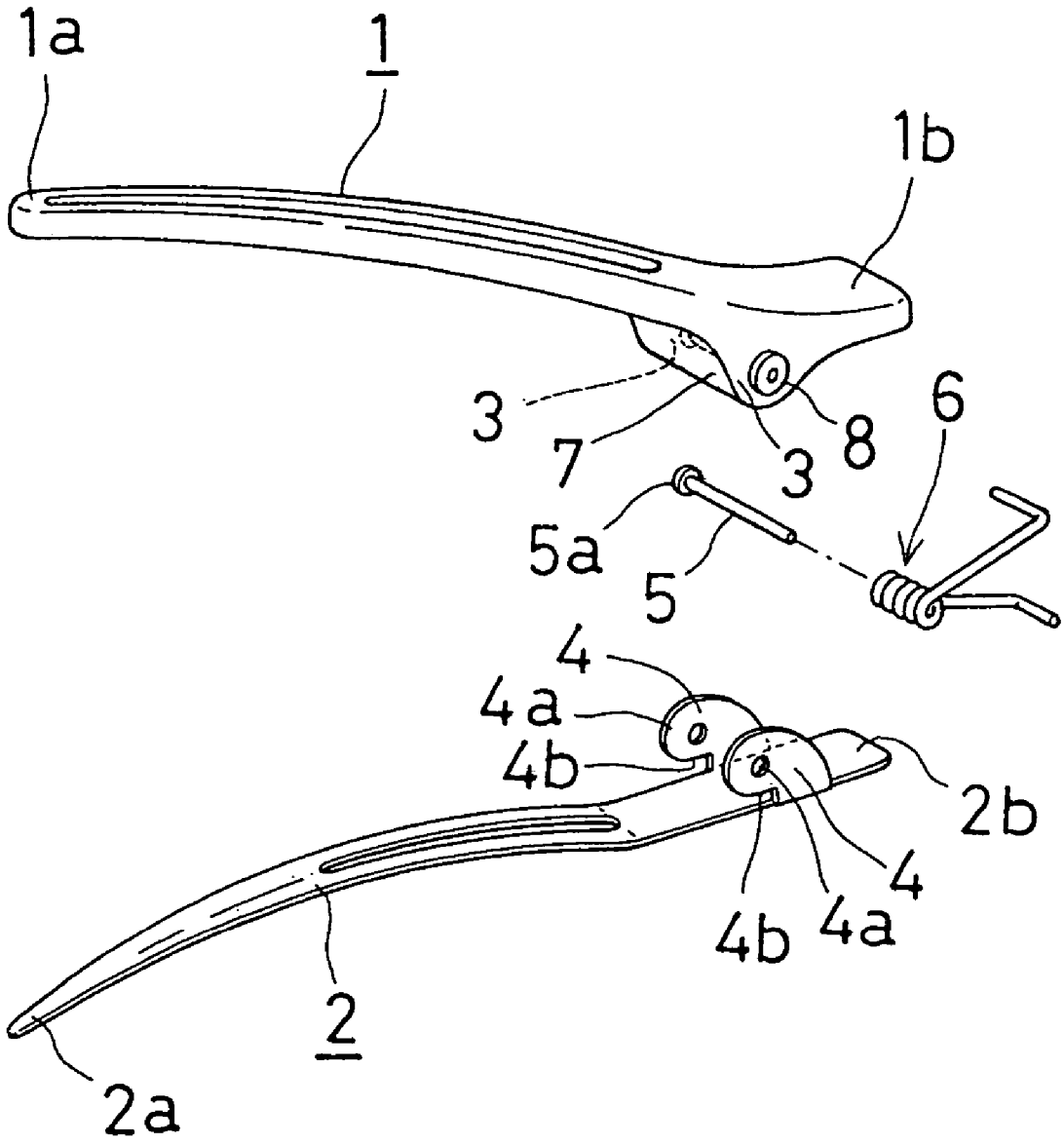
FIG. 3 shows an exploded perspective view of the hair clip shown in FIG. 1.

As best shown in FIG. 2B, the outside hinge ledges 3 and 3 of the first hair retainer 1 are disposed adjacent to and outside of the inside hinge ledges 4 and 4 of the second hair retainer 2. The end portions of the pivotal shaft 5 are fitted in the corresponding shaft-receiving apertures 3*a* and 4*a*, whereby the hair retainers 1 and 2 are pivoted, i.e., opened and closed, about the pivotal shaft 5.

As shown in FIG. 2A and 2B, the coil spring 6 is wounded around the pivotal shaft 5. The extended end portions of the coil spring 6 are fitted on the opposing inner surfaces of the lever portions 1*b* and 2*b* of the hair retainers 1 and 2. The coil spring 6 urges the second end portions 1*a* and 2*a* of the first and second hair retainers 1 and 2 in a closing direction. The coil spring 6 may be substituted by any other known member for urging the hair retainers 1 and 2 in a closing direction.

The corresponding hinge ledges 3 and 4 of the first and second hair retainers 1 and 2 are disposed side by side and fitted each other. However, in actual, the adjacent hinge ledges 3 and 4 are not tightly fitted each other so that the hair retainers 1 and 2 can be rotated without causing excessive friction. Thus, a gap is usually formed therebetween. As a result, in an actual use of the hair clip, there may be a possibility that hair is introduced into the gap and caught therein. In the state in which hair is caught by the adjacent hinge ledges 3 and 4, when the hair clip A is detached from the user's head, the hair may be pulled out of the user's head. Therefore, in this embodiment, in order to prevent hair from being introduced into the gaps, a hinge ledge cover 7 is integrally provided to the first hair retainer 1. This hinge ledge cover 7 integrally extends from the lower surface of the first hair retainer 1 so as to connect the inner edge portions of the outside hinge ledges 3 and 3 of the first hair retainer 1. In this specification, the inner edge portion of the outside hinge ledge 3 means an edge portion located at the second end portion side la of the first hair retainer 1 (i.e., the left side edge portion of the outside hinge ledge 3 in FIGS. 1, 3 and 4). Thus, in the assembled state (see FIG. 1), this hinge ledge cover 7 covers the inner edge portions of the inside hinge ledges 4 and 4 of the second hair retainer 2. In this specification, the inner edge portion of the inside hinge ledge 4 means an edge portion located at the second end portion side 2*a* of the second hair retainer 2 (i.e., the left side edge portion of the inside hinge ledge 4 in FIGS. 1, 3 and 4).

Each inside hinge ledge 4 is provided with a hinge ledge cover introducing slot 4*b* at the lower portion of the inner edge portion thereof so that the hinge ledge cover 7 can be introduced therein when the first and second hair retainers 1 and 2 are opened and closed.

As is apparent from the above, by providing the aforementioned hinge ledge cover 7, hair is prevented from being introduced into not only the gap formed between the adjacent inside and outside hinge ledges 3 and 4 but also the space formed between the inside ledges 4 and 4.

Furthermore, in this embodiment, in order to assuredly prevent hair from being introduced into the aforementioned gap and space regardless of the opening angle of the pair of hair retainers 1 and 2, the following structure is employed.

Figure 4A:
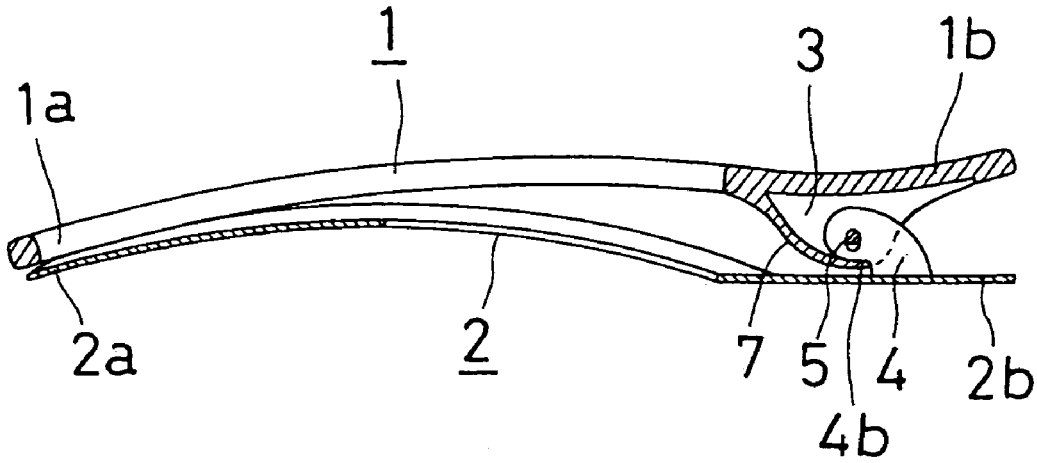
FIG. 4A shows a side cross-sectional view of the hair clip shown in FIG. 1 in a closed state.
Figure 4B:
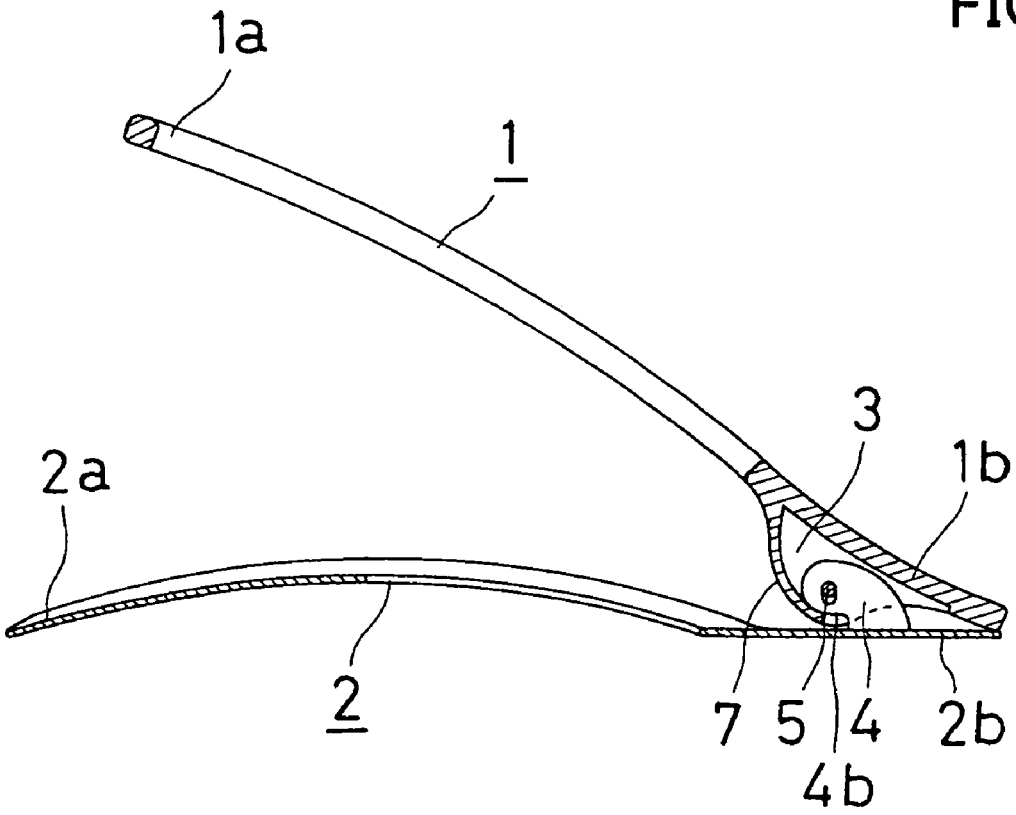
FIG. 4B shows a side cross-sectional view of the hair clip shown in FIG. 1 in an opened state.
Figure 5:
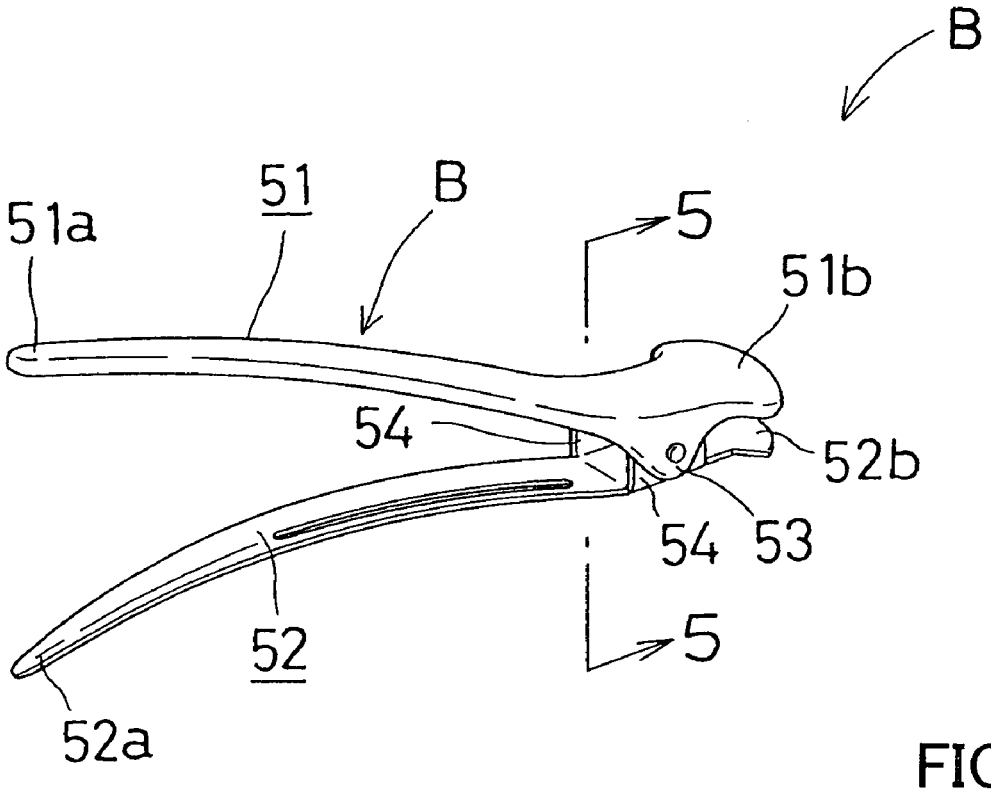
FIG.5 PRIOR ART
FIG. 5 shows a perspective view of a conventional hair clip in an opened state.
Figure 6:
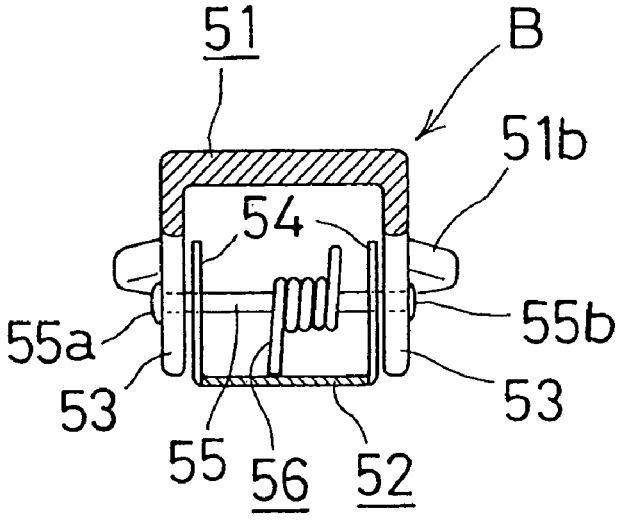
FIG.6 PRIOR ART
FIG. 6 shows an enlarged cross-sectional view taken along the line 5—5 in FIG. 5.

As shown in FIGS. 4A and 4B, a hinge ledge cover introducing slot 4*b* is formed at the basal end portion of each of the inside hinge ledges 4 and 4 of the second hair retainer 2. This slot 4*b* extends from the basal end portion of the inner edge portion beyond a region beneath the shaft-receiving aperture 4*a*. Thus, as shown in FIG. 4A, in the state in which the pair of hair retainers 1 and 2 are closed, the tip end (i.e., right hand end in FIG. 4A) of the hinge ledge cover 7 is introduced into the slot 4*b* beyond the region beneath the shaft-receiving aperture 4*a*. On the other hand, as shown in FIG. 4B, in the state in which the pair of hair retainers 1 and 2 are opened, the tip end of the hinge ledge cover 7 still located in the slot 4*b*, and therefore the hinge ledge cover 7 covers the inner edge portions of the inside hinge ledges 4 and 4 of the second hair retainer 2 so as to conceal the space between the inside hinge ledges 4 and 4. Thus, the gaps each formed between the adjacent inside and outside hinge ledges 3 and 4 and the space formed between the inside hinge ledges 4 and 4 are always covered by the hinge ledge cover 7 regardless of the opening angle of the pair of hair retainers 1 and 2. Therefore, hair is assuredly prevented from being introduced into the aforementioned gap and/or space.

In the meantime, the pivotal shaft 5 has originally an enlarged head portion 5*a* at its one end so that the shaft 5 can be inserted into the shaft receiving apertures 3*a* and 4*a* of the hinge ledges 3 and 4 from one side thereof. After the insertion of the pivotal shaft 5 into the shaft-receiving apertures 3*a* and 4*a*, the other end of the pivotal shaft 5 is deformed to have an enlarged head 5*b* (see FIG. 2B) so as not to be pulled out therefrom. Thus, the pivotal shaft 5 has enlarged head portions 5*a* and 5*b* at both ends. However, there may be a gap between the enlarged head portion 5*a* and 5*b* and the outer surface of the outside hinge ledge 3. Thus, in an actual use of the hair clip A, there may be a possibility that hair is caught by and between the enlarged head portion 5*a* and 5*b* and the outside hinge ledge 3. In the state in which hair is caught by and between the enlarged head portion 5*a* and 5*b* and the outside hinge ledges 3 and 3, when the hair clip is detached from the user's head, the hair may be pulled out of the user's head. In this embodiment, in order to prevent hair from being introduced into the gap, a cylindrical portion 8 for covering the enlarged head portion 5*a* and 5*b* is integrally formed on the outside surface of each of the outside hinge ledges 3 and 3 of the first hair retainer 1. Thus, hair is prevented from being inserted into the gap formed between the enlarged head portion 5*a* and 5*b* and the outside hinge ledges 3 and 3 because the enlarged head portion 5*a* and 5*b* is covered by the cylindrical portion 8.

In the aforementioned embodiment, although each hair retainer 1 and 2 is an elongated plate-shaped member, the present invention is not limited to it. The hair retainer may be of any shape so long as a pair of hair retainers are pivoted by hinge ledges.

According to the present invention, since the first hair retainer is provided with a hinge ledge cover connecting inner side edge portions of the outside hinge ledges of the first hair retainer located at the second end portion side thereof and covering inner side edge portions of the inside hinge ledges of the second hair retainer, the gap between the adjacent inside and outside hinge ledges and the space between the inside hinge ledges are covered by the hinge ledge cover. Accordingly, hair is prevented from being introduced into the gap and/or the space, and therefore it is prevented that hair is caught by the hair clip and pulled out of a user's head when detaching the hair clip from the user's head. Thus, the hair clip does not make the user uncomfortable. Furthermore, since the hinge ledge cover is provided along the inner side edge portions of the outside hinge ledges, the outside hinge ledges are strengthened, resulting in enhanced durability.

In cases where the hinge ledge cover introducing slot extends to a region below the pivotal shaft, whereby a tip end of the hinge ledge cover is positioned below the pivotal shaft in the hinge ledge cover introducing slot when the pair of hear retainers are in a closed position, the hair retainers can be closed assuredly, and the hinge ledge cover can assuredly cover the inside hinge ledges even in a state in which the hair retainers are in an opened state.

It cases where the hinge ledge cover and the outside hinge ledges of the first hair retainer cover the inside hinge ledges of the second hair retainer irrespective of the opening angle of the hair retainers, since the inside hinge ledges are almost covered by the hinge ledge cover from the closed state to the opened state of the hair retainers, it is prevented that hair is caught by the hair clip at the time of opening and/or closing hair retainers.

In cases where the hinge ledge cover integrally extends from an inner surface of the first hair retainer, it is more assuredly prevented that hair is caught by the hair clip.

In cases where each of the outside hinge ledges of the first hair retainer is provided with an outwardly protruded cylindrical portion formed on an outer surface thereof and surrounding the shaft-receiving aperture thereof and that each of enlarged head portions of the pivotal shaft is disposed in the cylindrical portion, each of the enlarged head portions of the pivotal shaft is disposed in the cylindrical portion and therefore the gap between the enlarged head portion and the outside hinge ledge can be covered by the cylindrical portion. Accordingly, it is prevented that hair is caught by the gap and pulled out of a user's head when detaching the hair clip from the user's head. Thus, the hair clip does not make the user uncomfortable. Furthermore, since the cylindrical portion is formed on the outside hinge portion, the outside hinge portion can be strengthened, resulting in enhanced durability.

In cases where the first hair retainer is an integral synthetic resin molded article, the first hair retainer can be easily colored or shaped as compared with a metallic hair retainer.

Furthermore, in cases where the second hair retainer is made of metal, the first hair retainer can hide the metallic inside hinge ledges of the second hair retainer, thereby improving the appearance of the hair retainer. However, the first hair retainer can be made of metal such as aluminum, stainless or the like.

In cases where the spring is a coil spring wounded around pivotal shaft, the hair retainers can be assuredly urged in its closing position with simple structure.

In cases where the second hair retainer is a metal plate press molded article, the second hair retainer can be formed easily.

The hair clip according to the present invention can be preferably applied to a hair clip having elongated first and second hair retainers and lever portions at the first and second end portions.

The terms and expressions which have been employed herein are used as terms of description and not of limitation, and there is no intent, in the use of such terms and expressions, of excluding any equivalents of the features shown and described or portions thereof, but it should be recognized that various modifications are possible within the scope of the invention claimed.

What is claimed is:

1. A hair clip, comprising first and second hair retainers for retaining hair there between, each of said hair retainers having a first end portion and a second end portion, a pivotal shaft for pivoting said hair retainers at said first end portions and a spring for urging said second end portions of said hair retainers in a closing direction thereof, wherein said first hair retainer is provided with a pair of opposing outside hinge ledges at said first end portion and said second hair retainer is provided with a pair of opposing inside hinge ledges at said first end portion, wherein said pair of outside hinge ledges of said first hair retainer are disposed outside of said pair of inside hinge ledges of said second retainer, and wherein said pivotal shaft is inserted into shaft-receiving apertures formed in said inside and outside hinge ledges so that said pair of hair retainers are pivoted about said pivotal shaft, characterized in that:

said first hair retainer is provided with a hinge ledge cover connecting inner side edge portions of said outside hinge ledges of said first hair retainer located at said second end portion side thereof and covering inner side edge portions of said inside hinge ledges of said second hair retainer, said inner side edge portions being portions located at said second end portion side of said second hair retainer, each of said inside hinge ledges is provided with a hinge ledge cover introducing slot corresponding to said hinge ledge cover at each basal end portion thereof, so that said pair of hair retainers takes a closed position with said hinge ledge cover fitted in said hinge ledge cover introducing slots, whereby said hinge ledge cover covers said inner side edge portions of said inside hinge ledges and a space between said inside hinge ledges irrespective of an opening angle of said hair retainers.

2. The hair clip as recited in claim 1, wherein said hinge ledge cover slot extends to a region below said pivotal shaft, whereby a tip end of said hinge ledge cover is positioned below said pivotal shaft in said hinge ledge cover introducing slot when said pair of hear retainers are in a closed position.

3. The hair clip as recited in claim 2, wherein said hinge ledge cover and said outside hinge ledges of said first hair retainer cover said inside hinge ledges of said second hair retainer irrespective of said opening angle of said hair retainers.

4. The hair clip as recited in claim 3, wherein said hinge ledge cover integrally extends from an inner surface of said first hair retainer.

5. The hair clip as recited in claim 4, wherein each of said outside hinge ledges of said first hair retainer is provided with an outwardly protruded cylindrical portion formed on an outer surface thereof and surrounding said shaft-receiving aperture thereof, and wherein each of enlarged head portions of said pivotal shaft is disposed in said cylindrical portion.

6. The hair clip as recited in claim 3, wherein each of said outside hinge ledges of said first hair retainer is provided with an outwardly protruded cylindrical portion formed on an outer surface thereof and surrounding said shaft-receiving aperture thereof, and wherein each of enlarged head portions of said pivotal shaft is disposed in said cylindrical portion.

7. The hair clip as recited in claim 2, wherein said hinge ledge cover integrally extends from an inner surface of said first hair retainer.

8. The hair clip as recited in claim 7, wherein each of said outside hinge ledges of said first hair retainer is provided with an outwardly protruded cylindrical portion formed on an outer surface thereof and surrounding said shaft-receiving aperture thereof, and wherein each of enlarged head portions of said pivotal shaft is disposed in said cylindrical portion.

9. The hair clip as recited in claim 2, wherein each of said outside hinge ledges of said first hair retainer is provided with an outwardly protruded cylindrical portion formed on an outer surface thereof and surrounding said shaft-receiving aperture thereof, and wherein each of enlarged head portions of said pivotal shaft is disposed in said cylindrical portion.

10. The hair clip as recited in claim 1, wherein said hinge ledge cover and said outside hinge ledges of said first hair retainer cover said inside hinge ledges of said second hair retainer irrespective of said opening angle of said hair retainers.

11. The hair clip as recited in claim 10, wherein said hinge ledge cover integrally extends from an inner surface of said first hair retainer.

12. The hair clip as recited in claim 11, wherein each of said outside hinge ledges of said first hair retainer is provided with an outwardly protruded cylindrical portion formed on an outer surface thereof and surrounding said shaft-receiving aperture thereof, and wherein each of enlarged head portions of said pivotal shaft is disposed in said cylindrical portion.

13. The hair clip as recited in claim 10, wherein each of said outside hinge ledges of said first hair retainer is provided with an outwardly protruded cylindrical portion formed on an outer surface thereof and surrounding said shaft-receiving aperture thereof, and wherein each of enlarged head portions of said pivotal shaft is disposed in said cylindrical portion.

14. The hair clip as recited in claim 1, wherein said hinge ledge cover integrally extends from an inner surface of said first hair retainer.

15. The hair clip as recited in claim 14, wherein each of said outside hinge ledges of said first hair retainer is provided with an outwardly protruded cylindrical portion formed on an outer surface thereof and surrounding said shaft-receiving aperture thereof, and wherein each of enlarged head portions of said pivotal shaft is disposed in said cylindrical portion.

16. The hair clip as recited in claim 1, wherein each of said outside hinge ledges of said first hair retainer is provided with an outwardly protruded cylindrical portion formed on an outer surface thereof and surrounding said shaft-receiving aperture thereof, and wherein each of enlarged head portions of said pivotal shaft is disposed in said cylindrical portion.

17. The hair clip as recited in any one of claims 1–2 or 10–16, wherein said first hair retainer is an integral synthetic resin molded article.

18. The hair clip as recited in claim 1, wherein said second hair retainer is a metal plate press molded article.

19. The hair clip as recited in claim 1, wherein said first and second hair retainers are an elongated member respectively, and wherein said first end portions of said first and second hair retainers constitute lever portions.

* * * * *